US006576072B2

(12) United States Patent
Chan et al.

(10) Patent No.: US 6,576,072 B2
(45) Date of Patent: Jun. 10, 2003

(54) INSENSITIVE HIGH ENERGY BOOSTER PROPELLANT

(75) Inventors: May L. Chan, Ridgecrest, CA (US); Alan D. Turner, Ridgecrest, CA (US)

(73) Assignee: The United States of Americas as represented by the Secretary of the Navy, Washington, DC (US)

( * ) Notice: Subject to any disclaimer, the term of this patent is extended or adjusted under 35 U.S.C. 154(b) by 192 days.

(21) Appl. No.: 09/798,013

(22) Filed: Feb. 27, 2001

(65) Prior Publication Data

US 2002/0166612 A1 Nov. 14, 2002

(51) Int. Cl.[7] ..... C06B 45/10

(52) U.S. Cl. ..... 149/19.2; 149/42; 149/49; 149/76

(58) Field of Search ..... 149/46, 42, 76, 149/19.2

(56) References Cited

U.S. PATENT DOCUMENTS

| | | | | |
|---|---|---|---|---|
| 3,830,673 A | * | 8/1974 | Fletcher et al. | 149/17 |
| 4,302,258 A | * | 11/1981 | Fukuma et al. | 149/19.1 |
| 5,712,511 A | | 1/1998 | Chan et al. | |
| 6,086,692 A | | 7/2000 | Hawkins et al. | |

OTHER PUBLICATIONS

Cohen, Norman, A Review of Models and Mechanismas for Pressure Exponent Breaks in Composite Solid Propellants, Proceedings of 23rd JANNAF Combustion Meeting, Oct. 1986, pp. 31–42, CPIA Publication 457. vol. II.

A. I. Atwood, P.O. Curran, C.F. Price, T. L. Boggs, D. Booth, High–pressure Burning Rate Studies of Ammonium Perchlorate (AP) Based Propellants, Proceedings for Research for Research and Technology, Agency of North Atlantic Treaty Organization (NATO) 1999 Meeting on Small Rocket Motors and Gas Generators for Land, Sea, and Air Launched Weapon Systems, 19–23 Apr. 1999, Corfu, Greece.

T. L. Boggs & D. E. Zurn, Ammonium Perchlorate Combustion: Effects of Sample Preparation; and Pressure, Temperature and Acceleration Environments, Combustion Science and Technology, 1973, pp. 177–183, vol. 7, Gordon and Breach, Science Publishers Ltd., United Kingdom.

* cited by examiner

*Primary Examiner*—John Hardee

(74) *Attorney, Agent, or Firm*—Anthony P. Serventi; Laura R. Foster; Charlene A. Haley

(57) ABSTRACT

The invention disclosed herein relates to solid propellant formulations, which exhibit good processing properties, good safety characteristics, desirable combustion properties, good safety characteristics and excellent mechanical attributes. The solid propellant formulations disclosed herein burn at a rate of about 0.5 in/s at 1000 psi and show no pressure slope break up to 8000 psi. The solid propellant formulations of the disclosed invention incorporate oxidizers of varying particle size to avoid a pressure slope break. The solid propellant formulations of the present invention avoid the use of large-size ammonium perchlorate (AP) particles having particle size in the range of 200–400 $\mu$m to avoid the pressure slope break problem, which typically occurs at about 2500 psi to 3500 psi. In addition, the formulations avoid using exotic burn rate catalysts such as superfine iron oxide, chromic oxide, catocene, or carboranes, because some of these catalysts are toxic and hazardous to the environment and give poor IM effects. Preferably, the formulations incorporate aluminum oxide having a surface area of about 85 to about 115 $m^2/g$ as the burn rate catalyst.

13 Claims, 5 Drawing Sheets

INSENSITIVE HIGH ENERGY BOOSTER PROPELLANT

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

This invention relates to solid propellant formulations, which exhibit good processing properties, good safety characteristics, desirable combustion properties, good safety characteristics and excellent mechanical attributes. More specifically, this invention relates to solid propellant formulations, which have a burning rate of 0.5 in/s at 1000 psi and show no pressure slope break up to 8000 psi.

2. Description of the Prior Art

Solid propellants are used extensively in the aerospace industry. Solid propellants have developed as the preferred method of powering most missiles and rockets for military, commercial, and space applications. Solid rocket motor propellants have become widely accepted because of the fact that they are relatively simple to formulate and use, and they have excellent performance characteristics. Furthermore, solid propellant rocket motors are generally very simple when compared to liquid fuel rocket motors. For all of these reasons, it is found that solid rocket propellants are often preferred over other alternatives, such as liquid propellant rocket motors.

Conventional solid propellant rocket motors operate by generating large amounts of hot gases from the combustion of a solid propellant formulation stored in the motor casing. Typical solid rocket motor propellants are generally formulated having an oxidizing agent, a fuel, and a binder. At times, the binder and the fuel may be the same. In addition to the basic components set forth above, it is conventional to add various plasticizers, curing agents, cure catalysts, and other similar materials which aid in the processing and curing of the propellant. A significant body of technology has developed related solely to the processing and curing of solid propellants, and this technology is well known to those skilled in the art.

During operation, the gases generated from the combustion of the solid propellant accumulate within the combustion chamber until enough pressure is amassed within the casing to force the gases out of the casing and through an exhaust port. The expulsion of the gases from the rocket motor and into the environment produces thrust. Thrust is measured as the product of the total mass flow rate of the combustion products exiting the rocket multiplied by the velocity of the exiting combustion products plus the product of the change in pressure at the exit plane multiplied by the exit area. Increasing the pressure at which the gases are expelled from the combustion chamber raises the thrust level, which in turn increases the propulsion rate of the vehicle containing the rocket motor to thereby permit the vehicle to achieve higher speeds.

One type of propellant that is widely used incorporates ammonium perchlorate (AP) as the oxidizer. The AP oxidizer may then, for example, be incorporated into a propellant that is bound together by a hydroxyl-terminated polybutadiene (HTPB) binder. Such binders are widely used and commercially available. It has been found that such propellant compositions provide ease of manufacture, relative ease of handling, good performance characteristics; and are at the same time economical and reliable. In essence it can be said that AP composite propellants have been the backbone of the solid propulsion industry for approximately the past 40 years.

High-performance booster propellants are being developed not only because they can deliver superior results but also because they can be used in numerous propulsion systems. One of the problems associated with conventional propellant formulations having an exponentially increasing propellant burn rate is that an increase consumption of propellant generally increases the operating pressure, which in turn increases the risk of catastrophic failure of the rocket motor casing. This insufficiency springs from the inherent combustion characteristics of AP, which often impart the propellant a high-pressure slope break between 2500 to 3500 psi. Therefore, to avoid this slope break region, propulsion systems designers generally devise motors that operate below 2000 psi, even though it is known that much higher performance can be achieved if the motor can operate at pressures higher than 2000 psi. The change in burning rate ($r_b$) as a function of the pressure change, $P_c$, is defined as the burning rate slope, n:

$$n = \left(\frac{\partial \ln r_b}{\partial \ln P_c}\right)_T$$

Data for determining burning rates at different pressures are typically gathered either by standard strand testing or by test motor analysis. The determination of burning rates by such testing procedures is well known in the art. Generally, conventional solid rocket propellant formulations have burn rate slopes of 0.15 or greater, but well below 1.0. Conventional propellants usually exhibit a dramatic positive increase in burning rate slope at pressures above about 2500 psi to 3500 psi, as illustrated in FIG. 1.

The conventional solution to avoiding catastrophic failure of the rocket motor casing is to strengthen the rocket motor casing by constructing the casings with thick walls from strong, dense materials, such as steel. This approach, however, deleteriously imparts a severe weight penalty to the vehicle. Consequently, a greater amount of thrust and an increased propellant burn rate is required to propel the vehicle at a comparable rate. Because of the recent successes in manufacturing new composite motor cases, which can sustain much higher chamber pressures, it is possible to develop a motor that can deliver increased performance as measured by specific impulse (Isp).

Regardless of advances in rocket motor casings, it is highly desirable to search for a high-energy propellant material that does not exhibit a pressure slope break. While the exact cause is unknown, one theory is that it is due to a change in the mechanism from diffusion flame control to solid AP flame control at the higher pressures that exist in burning propellants, as described in "A Review of Models and Mechanisms for Pressure Exponent Breaks in Composite Solid Propellants", Cohen, N., *Proceedings of* 23$^{rd}$ *JANNAF Combustion Meeting,* CPIA Publication 457, Vol. II (October 1986), incorporated herein by reference. For example, burning solid AP is much more sensitive to pressure fluctuation (i.e., high slope) than materials experiencing diffusion-control-type burning.

Because conventional booster propellants (HTPB/AP/aluminum) are often composed of a mixture of different AP particle sizes, optimum packing efficiency (i.e., good processing properties) is important in attaining high performance and, at times, in providing burn rate tailorability. The various AP powders often contain large pieces (i.e., 200 μm to 400 μm) and it is extremely likely that the large-size AP particles contribute to the pressure slope break problem. Previous work has demonstrated that the slope break is delayed from 2500 psi to much higher pressures (as high as 10,000 psi) when the propellant formulations do not contain large AP particles. Therefore, many formulations instead incorporate high levels of ultrafine AP and exotic bum rate catalysts, such as superfine iron oxide, chromic oxide, catocene, or carboranes to achieve the higher pressure slope break.

Attempts have been made to solve the problems associated with the high-pressure slope break that occurs between 2500 psi and 3500 psi with ammonium perchlorate as an oxidizer. The problem is discussed in detail in the following publications: Atwood, A. I. et al., "High-pressure Burning Rate Studies of Ammonium Perchlorate (AP) Based Propellants," *Proceedings for Research and Technology Agency of North Atlantic Treaty Organization* (*NATO*) 1999 *Meeting on Small Rocket Motors and Gas Generators for Land, Sea, and Air Launched Weapon Systems,* Apr. 19–23, 1999, Corfu, Greece and Boggs, T. L., et al., "Ammoniun Perchlorate Combustion: Effects of Sample Preparation; Ingredient Type; and Pressure, Temperature and Acceleration Environments," *J. Combustion Science and Technology,* Vol. 7, pp. 177–183 (1973), incorporated herein by reference. U.S. Pat. No. 6,086,692 issued to Hawkins et al. on Jul. 11, 2000 discloses a solid rocket propellant formulation operable at high pressures with burn rates relatively insensitive to changes in pressure and propellant temperature. However, the propellant formulation of U.S. Pat. No. 6,086,692 shows a double plateau, rather than the constant low slope of the invention of the current application. Also, the propellant formulation of U.S. Pat. No. 6,086,692 does not combine a good burning rate with good hazard properties like the invention of the current application. In addition the invention of the current application uses different sets of ingredients and particle sizes to achieve a performance not found in the propellant formulation of U.S. Pat. No. 6,086,692.

SUMMARY OF THE INVENTION

It is an object of the present invention to produce a IMAD-213 AP solid propellant formulation having a pressure slope break higher than about 2500 psi to 3500 psi comprising about 6.0 to about 6.5 weight % of at least one energetic polymeric binder; about 25 to about 32 weight % ammonium perchlorate having a particle size of about 10 μm to about 15 μm as a primary oxidizer; about 18 to about 24 weight % ammonium perchlorate having a particle size of about 80 μm to about 100 μm as a secondary oxidizer; about 10 to about 15 weight % of ammonium nitrate having a particle size of about 40 μm to about 60 μm as a co-oxidizer; about 19 to about 24 weight % of a metal fuel; and about 0.3 to about 0.6 weight % of a burn rate catalyst. Further, the solid propellant formulation bums at a rate of about 0.5 in/s at about 1000 psi and shows no pressure slope break up to about 8000 psi. Also, the IMAD-213 AP solid propellant formulation may contain a plasticizer, a curative, a stabilizer, a cure catalyst, and a bonding agent, depending upon the desired characteristics of the propellant.

Another object of the present invention is to provide a IMAD-213 CL-20 solid propellant formulation having a pressure slope break occurring higher than about 2500 psi to 3500 psi comprising about 6.0 to about 6.5 weight % of at least one energetic polymeric binder; about 18 to about 24 weight % ammonium perchlorate having a particle size of about 80 μm to about 100 μm as a primary oxidizer; about 10 to about 15 weight % of CL-20 having a particle size less than about 2.0 μm as a secondary oxidizer; about 25 to about 32 weight % of ammonium nitrate having a particle size of about 40 μm to about 60 μm as a co-oxidizer; about 19 to about 24 weight % of a metal fuel; and about 0.3 to about 0.6 weight % of a burn rate catalyst. Further, the solid propellant formulation burns at a rate of about 0.5 in/s at about 1000 psi and shows no pressure slope break up to about 8000 psi. The IMAD-213 CL-20 solid propellant formulation may contain a plasticizer, a curative, a stabilizer, a cure catalyst, and a bonding agent, depending upon the desired characteristics of the propellant.

Another objective of a preferred embodiment of the present invention is to provide a IMAD-213 RDX solid propellant formulation having a pressure slope break higher than about 2500 psi to 3500 psi comprising: about 6.0 to about 6.5 weight % of at least one energetic polymeric binder; about 18 to about 22 weight % ammonium perchlorate having a particle size of about 10 μm to about 15 μm as a first oxidizer; about 18 to about 22 weight % ammonium perchlorate having a particle size of about 80 μm to about 100 μm as a second oxidizer; about 8 to about 10 weight % of RDX having a particle size of about 1.7 μm to about 2.5 μm as a third oxidizer; about 10 to about 15 weight % of ammonium nitrate having a particle size of about 40 μm to about 60 μm as a co-oxidizer; about 20 to about 24 weight % of a metal fuel; and about 0.2 to about 0.5 weight % of a burn rate catalyst. Further, the solid propellant formulation burns at a rate of about 0.5 in/s at about 1000 psi and shows no pressure slope break up to about 8000 psi. The IMAD-213 RDX solid propellant formulation may contain a plasticizer, a curative, a stabilizer, a cure catalyst, and a bonding agent, depending upon the desired characteristics of the propellant.

One object of the present invention is to provide high-performance shock insensitive booster propellant formulations which burn at a constant rate of about 0.5 in/s at about 1000 psi and do not exhibit a pressure slope break between about 2500 to 3500 psi.

Another object of the invention is to provide high-performance shock insensitive booster propellant formulations in which the pressure slope break is delayed to pressures as high as 10,000 psi.

Another object of the invention is to provide high-performance shock insensitive booster propellant formulations that avoid the use of AP having a particle size from about 200 μm to about 400 μm.

A still further object of the invention is to provide high-performance shock insensitive booster propellant formulations which are environmentally friendly and do not incorporate exotic burn rate catalysts such as superfine iron oxide, chromic oxide, catocene, or carboranes.

DETAILED DESCRIPTION OF THE INVENTION

Figure 1:
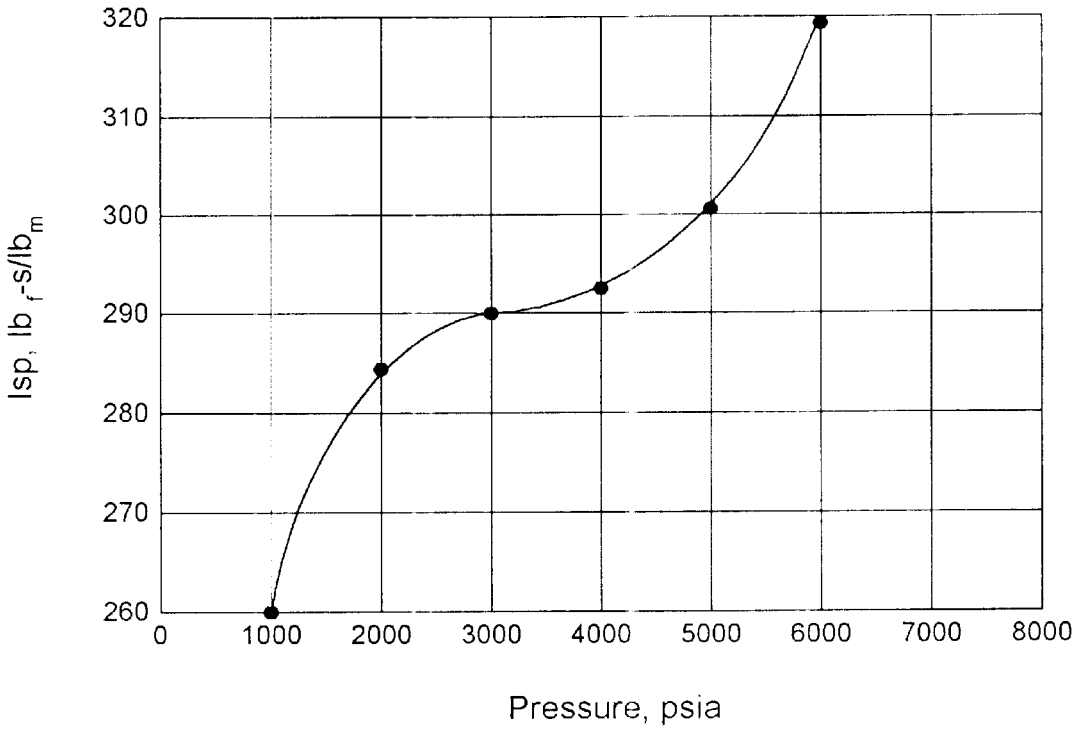
FIG. 1 is a graph, which illustrates the performance of a conventional prior art propellant in terms of pressure versus burn rate.

The solid propellant formulations of the present invention avoid the use of large-size ammonium perchlorate (AP) particles, those having a size of about 200–400 μm, to eliminate the pressure slope break problem, which typically occurs at about 2500 psi to about 3500 psi. In a preferred embodiment of the present invention, the solid propellant formulations burn at a rate of about 0.5 in/s at about 1000 psi and show no pressure slope break up to about 8000 psi. In addition, the formulations avoid using exotic burn rate catalysts such as superfine iron oxide, chromic oxide, catocene, or carboranes, because some of these catalysts are toxic and hazardous to the environment and give poor IM effects. The solid propellant formulations of a preferred embodiment of the present invention utilize oxidizers such as hexa-nitro-hexa-aza-isowurtzitane (CL-20), cyclotrimethylenetrinitramine (RDX) and cyclotetramethylene tetranitramine (HMX) as replacements for some of the AP. Oxidizers such as RDX, CL-20 and HMX can minimize the effect of the burning AP and increase the energy of the propellant at the same time. Also, a preferred embodiment of the present invention utilizes ammonium nitrate (AN) to achieve a slow cookoff and to obtain desirable IM responses as demonstrated in the HTPE propellant work described in "Insensitive HTPE Propellants", Comfort, F. et al., *Insensitive Munitions Technology Symposium*, ADPA, San Diego, Calif. (Mar. 18–20, 1996), incorporated herein by reference.

A solid rocket propellant formulation, according to a preferred embodiment of the present invention, given the acronym IMAD-213 AP and illustrated in 1A, is formulated from the following ingredients:

TABLE 1A

| Ingredient | Weight % (Approximate) |
|---|---|
| AP, 80–100 μm (Oxidizer) | 18–24 |
| AP, 10–15 μm (Oxidizer) | 25–32 |
| AN (Oxidizer) | 10–15 |
| Polymeric Binder | 6–6.5 |
| Al Fuel | 19–24 |
| Plasticizer | 7.0–15 |
| Cure Catalyst | 0.03–0.06 |
| Burn Rate Catalyst | 0.3–0.6 |
| Bonding Agent | 0.05–0.12 |
| Stabilizer | 0.3–0.4 |
| Curative | 1.3–2.0 |

In the formulation for IMAD-213 AP, ammonium perchlorate (AP) is generally incorporated into the formulation in the manner known in the art and AP may be used in multiple particle sizes. In a preferred embodiment of the present invention, the AP having a particle size of 10–15 μm, preferably about 11 μm, is used as a first oxidizer. The first oxidizer AP comprises about 25 weight % to about 32 weight %, preferably about 30 weight %. The AP having a particle size of 80–100 μm, preferably about 90 μm, is used as a secondary oxidizer. The secondary oxidizer AP comprises about 18 weight % to about 24 weight %, preferably about 20 weight %.

The metal fuel used the IMAD-213 AP formulations is A1 fuel, preferably in a range of about 19–24 weight %, preferably about 19 weight %. The fuel can be comprised of aluminum metal with a particle size in the range of 30–95 μm, preferably about 95 μm.

AN is used in the propellant formulations as a co-oxidizer. In a preferred embodiment of the present invention, AN can have a particle size in the range of about 40–60 μm, preferably about 40 μm. The AN is incorporated at about 10–15 weight %, preferably at about 10 weight %

The polymeric binder used in a preferred embodiment of the present invention is CAPA 720® (2-oxepanone, polymer with alpha-hydro-omega-hydroxypoly (oxy-1,4-butanediol)), which is a type of polycaprolactone. Suitable binders for IMAD-213 AP also include other polycaprolactones, hydroxyl-terminated polyethers and polyesters known in the art. Other suitable binders include polyethylene glycol, copolymer of polyethylene glycol, polypropylene glycol and copolymer of polypropylene glycol. In a preferred embodiment of the present invention relating to TMAD-213 AP, the polymeric binder comprises about 6.0–6.5 weight % of the formulation, preferably at about 6.5 weight %.

Aluminum oxide is a suitable burn rate catalyst and is preferable to exotic burn rate catalysts such as superfine iron oxide, chromic oxide, catocene, or carboranes. Aluminum oxide is more environmentally friendly than the aforementioned exotic burn rate catalysts and aluminum oxide gives better IM effects. The aluminum oxide burn rate catalyst raises the burn rate at lower temperatures to create a consistent burn rate up to 8000 psi. In a preferred embodiment of the present invention, the aluminum oxide has a high surface area of 85–115 $m^2/g$. In a preferred embodiment of the present invention relating to IMAD-213 AP, the high surface area aluminum oxide comprises about 0.3–0.6 weight % of the formulation, preferably at about 0.5 weight %.

The basic formulation of IMAD-213 AP consists of metal fuel, binder, oxidizers and a burn rate catalyst. However, cure catalysts, curatives, crosslinkers, thermal and aging stabilizers, opacifiers and other such ingredients commonly utilized in solid propellant formulations may be added, depending upon the desired characteristics.

A suitable stabilizer is MNA (N-methyl-p-nitroaniline). Stabilizer is used to stabilize nitrate ester plasticizer and AN oxidizer in order to prolong shelf life. Other suitable stabilizers for nitrate esters include 2-NDPA (2-nitrodiphenylamine), and other stabilizers well known in the art. In a preferred embodiment of the present invention relating to IMAD-213 AP, MNA is incorporated at about 0.3–0.4 weight %, preferably at about 0.3 weight %.

A curative can also be added to the formulation, and examples of suitable curatives include polyfunctional isocyanates, such as HMDI (hexamethylene diisocyanate), TMXDI (m-tetramethylxylene diisocyanate), DDI (dimeryl diisocyanate), TDI (toluene diisocyanate), polymeric hexamethylene diisocyanate, IPDI (isophorone diisocyanate) and Desmodur N-100™ (biuret triisocyanate) as commercially available from Mobay. These curatives may be used independently or in combination. In a preferred embodiment of the present invention relating to IMAD-213 AP, HMDI and N-100™ are used in combination. HMDI is incorporated at about 0.3–0.6 weight %, preferably at about 0.5 weight % and N-100 is incorporated at about 0.9–1.4 weight %, preferably at about 0.9 weight %.

Suitable plasticizers include TEGDN, (triethyleneglycol dinitrate), or Butyl NENA, (n-butyl-2-nitratoethyl-nitramine) or mixtures of the two. Other suitable plasticizers include DEGDN (diethyleneglycol dinitrate), TMETN (trimethylolethane trinitrate), and BTTN (butanetriol trinitrate). These plasticizers may be used independently or in combination. In a preferred embodiment of the present invention relating to IMAD-213 AP, TEGDN and Butyl NENA are used in combination. TEGDN is incorporated at about 0.0–3.0 weight %, preferably at about 2.4 weight % and Butyl NENA is incorporated at about 7.0–12.0 weight %, preferably at about 9.7 weight %.

TPB (triphenyl bismuth) is a suitable cure catalyst. Other suitable cure catalysts include TPTC (triphenyltin chloride), dibutyltin diacetate, and dibutyltin dilaurate. These compounds and others may be used as needed to prepare a propellant formulation with the specific desired characteristics. In a preferred embodiment of the present invention relating to IMAD-213 AP, TPB comprises about 0.03–0.06 weight % of the formulation, preferably at about 0.03 weight %.

The mixing is accomplished using methods known in the art. The mixing of the aforementioned ingredients is accomplished by using a vertical shear mixer. At the end of mixing, the propellant mixture is vacuum cast into various molds or test items to determine various characteristics. For a more detailed description of mixing technique, refer to U.S. Pat. No. 5,712,511 issued to Chan et al. on Jan. 27, 1998, incorporated by reference herein.

Depending on the desired application, the performance of the solid propellant according to the present invention may be further maximized by the use of an all-boost propellant grain design. An all-boost propellant grain design features a grain geometry that results in a high thrust level throughout the entire burn period. This is in contrast to conventional tactical missile rocket motors which sometimes utilize a boost-sustain thrust profile, which starts at a high thrust level but over time falls to a lower thrust level. The boost-sustain thrust profile limits the performance advantages achieved with the present invention.

An all-boost grain design can result in vehicle velocities exceeding the current state-of-the-art design parameters due to the resulting increased thermal stress. The increases in thermal stress can be reduced by using, for example, a pulse motor design wherein the thrust is divided into two or more pulses and the propellant grains are separated by a pressure bulkhead. When necessary to reduce the maximum mach number to within design parameters, the rocket motor can have a delay between the pulses to allow the missile velocity to decrease before firing the next impulse. Grain patterns that are known to those of skill in the art can be utilized to obtain the all-boost thrust profile.

It is possible by selection of varied formulation parameters to control the ballistic behavior of the propellant. The slopes and burn rates can be tailored via formula modification. Additionally, changes in selection of the curative and particle size of the ballistic modifier can produce slopes at different burn rates and pressure regions.

A solid rocket propellant formulation, according to a preferred embodiment of the present invention, given the acronym IMAD-213 CL-20 and illustrated in Table 1B, is formulated from the following ingredients:

TABLE 1B

| Ingredient | Weight % (Approximate) |
|---|---|
| AP, 80–100 μm (Oxidizer) | 18–24 |
| CL-20 (Oxidizer) | 25–32 |
| AN (Oxidizer) | 10–15 |
| Polymeric Binder | 6–6.5 |
| Al Fuel | 19–24 |
| Plasticizer | 7–15 |
| Cure Catalyst | 0.03–0.06 |
| Burn Rate Catalyst | 0.3–0.6 |
| Bonding Agent | 0.1–0.15 |
| Stabilizer | 0.3–0.4 |
| Curative | 1.3–2.0 |

In the formulation for IMAD-213 CL-20, ammonium perchlorate (AP) is generally incorporated into the formulation in the manner known in the art and AP may be used in multiple particle sizes. The AP is used as a first oxidizer and can have a particle size in the range of about 80–100 μm, preferably about 90 μm. The first oxidizer AP comprises about 18 weight % to about 24 weight %, preferably about 20 weight %.

In the formulation for IMAD-213 CL-20, a nitramine oxidizer, CL-20, is incorporated to obtain the desired high pressure, low burn rate slope performance. In a preferred embodiment of the present invention, CL-20 can have a particle size in the range of less than about 3.0 μm, preferably less than about 2.0 μm. The CL-20 is incorporated at about 25–32 weight %, preferably at 30 weight %.

The metal fuel used the IMAD-213 CL-20 formulations is Al fuel, preferably in a range of about 19–24 weight %, preferably about 19 weight %. The fuel can be comprised of aluminum metal with a particle size in the range of 30–95 μm, preferably about 95 μm AN is used in the propellant formulations as a co-oxidizer. In a preferred embodiment of the present invention, AN can have a particle size in the range of about 40–60 μm, preferably about 40 μm. The AN is incorporated at about 10–15 weight %, preferably at about 10 weight %.

The polymeric binder used in a preferred embodiment of the present invention is CAPA 720® (2-oxepanone, polymer with alpha-hydro-omega-hydroxypoly (oxy-1,4-butanediol)), which is a type of polycaprolactone. Suitable binders for IMAD-213 CL-20 also include other polycaprolactones, hydroxyl-terminated polyethers and polyesters known in the art. Other suitable binders include polyethylene glycol, copolymer of polyethylene glycol, polypropylene glycol and copolymer of polypropylene glycol. In a preferred embodiment of the present invention relating to IMAD-213 AP, the polymeric binder comprises about 6.0–6.5 weight % of the formulation, preferably at about 6.5 weight %.

Aluminum oxide is a suitable burn rate catalyst and is preferable to exotic burn rate catalysts such as superfine iron oxide, chromic oxide, catocene, or carboranes. Aluminum oxide is more environmentally friendly than the aforementioned exotic burn rate catalysts and aluminum oxide gives better IM effects. The aluminum oxide burn rate catalyst raises the burn rate at lower temperatures to create a consistent burn rate up to 8000 psi. In a preferred embodiment of the present invention, the aluminum oxide has a high surface area of 85–115 $m^2/g$. In a preferred embodiment of the present invention relating to IMAD-213 AP, the high surface area aluminum oxide comprises about 0.3–0.6 weight % of the formulation, preferably at about 0.5 weight %.

The basic formulation of IMAD-213 CL-20 consists of metal fuel, binder, oxidizers and a burn rate catalyst. However, cure catalysts, curatives, crosslinkers, thermal and aging stabilizers, opacifiers and other such ingredients commonly utilized in solid propellant formulations may be added, depending upon the desired characteristics.

A suitable stabilizer is MNA (N-methyl-p-nitroaniline). Other suitable stabilizers for nitrate esters include 2-NDPA (2-nitrodiphenylamine), and other stabilizers well known in the art. In a preferred embodiment of the present invention, MNA is incorporated at about 0.3–0.4 weight %, preferably at about 0.3 weight %.

A curative can also be added to the formulation, and examples of suitable curatives include polyfunctional isocyanates, such as HMDI (hexamethylene diisocyanate), TMXDI (m-tetramethylxylene diisocyanate), DDI (dimeryl diisocyanate), TDI (toluene diisocyanate), polymeric hexamethylene diisocyanate, IPDI (isophorone diisocyanate) and Desmodur N-100™ (biuret triisocyanate) as commercially available from Mobay. These curatives may be used independently or in combination. In a preferred embodiment of the present invention relating to IMAD-213 CL-20, HMDI and N-100 are used in combination. HMDI is incorporated at about 0.3–0.6 weight %, preferably at about 0.4 weight % and N-100 is incorporated at about 1.0–1.4 weight %, preferably at about 1.4 weight %.

Suitable plasticizers include TEGDN, (triethyleneglycol dinitrate), or Butyl NENA, (n-butyl-2-nitratoethylnitramine) or mixtures of the two. Other suitable plasticizers include DEGDN (diethyleneglycol dinitrate), TMETN (trimethylolethane trinitrate), and BTTN (butanetriol trinitrate). These plasticizers may be used independently or in combination. In a preferred embodiment of the present invention relating to IMAD-213 CL-20, TEGDN and Butyl NENA are used in combination. TEGDN is incorporated at about 0.0–3.0 weight %, preferably at about 2.1 weight % and Butyl NENA is incorporated at about 7.0–12.0 weight %, preferably at about 9.0 weight %.

TPB (triphenyl bismuth) is a suitable cure catalyst. Other suitable cure catalysts include TPTC (triphenyltin chloride), dibutyltin diacetate, and dibutyltin dilaurate. These compounds and others may be used as needed to prepare a propellant formulation with the specific desired characteristics. In a preferred embodiment of the present invention relating to IMAD-213 CL-20, TPB comprises about 0.03–0.06 weight % of the formulation, preferably at about 0.03 weight %.

The mixing is accomplished using methods known in the art. The mixing of the aforementioned ingredients is accomplished by using a vertical shear mixer. At the end of mixing, the propellant mixture is vacuum cast into various molds or test items to determine various characteristics. For a more detailed description of mixing technique, refer to U.S. Pat. No. 5,712,511 issued to Chan et al. on Jan. 27, 1998, incorporated by reference herein.

Figure 5:
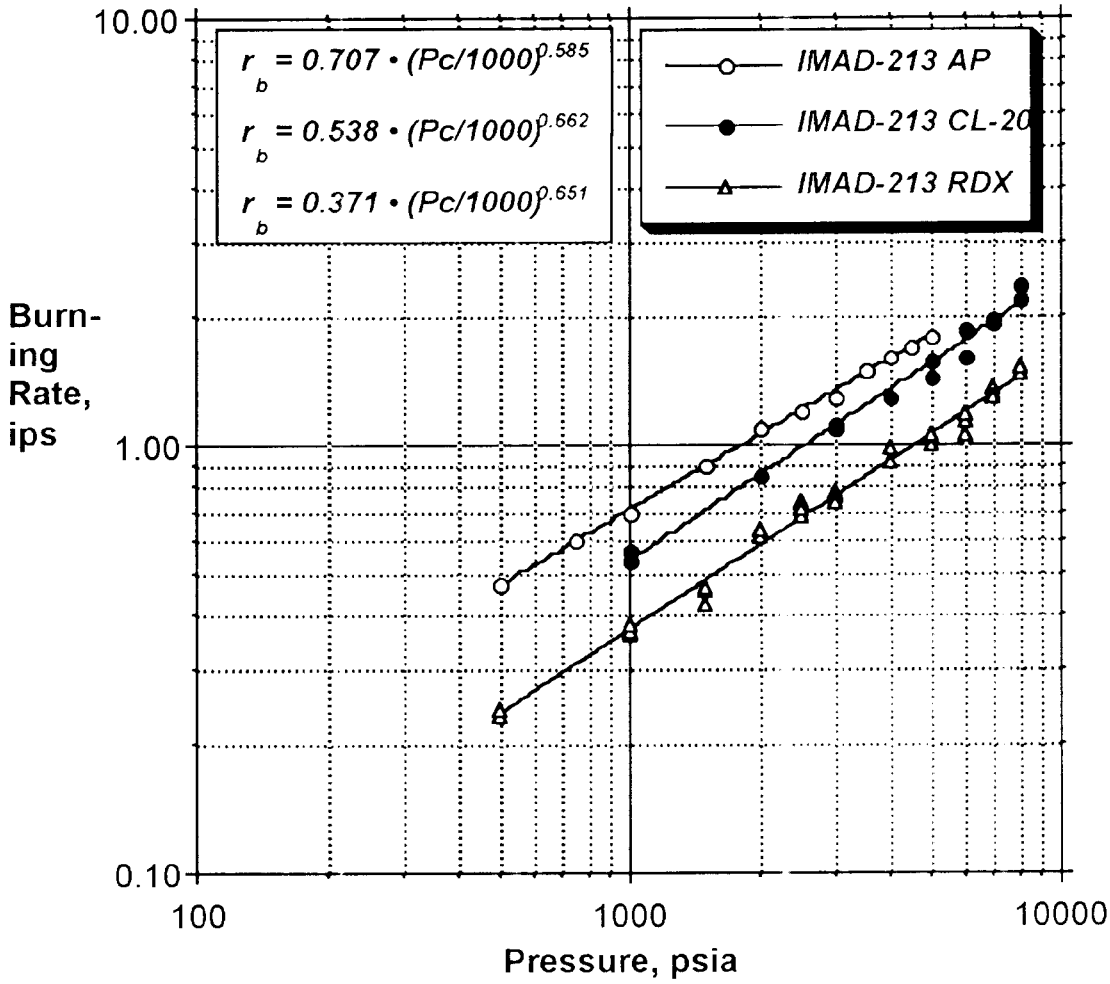
FIG. 5 is a graph, which illustrates the burning rate slope of a preferred embodiment of the present invention in terms of log chamber pressure versus log burning rate for IMAD-213 AP, IMAD-213 CL-20 and IMAD-213 RDX.

The addition of a nitramine oxidizer, such as CL-20 or RDX, increases the performance of the formulations by increasing the chemical energy. Also, the addition of a nitramine oxidizer, such as CL-20 or RDX, decreases the burning rate, as shown in FIG. 5.

Depending on the desired application, the performance of the solid propellant according to the present invention may be further maximized by the use of an all-boost propellant grain design. An all-boost propellant grain design features a grain geometry that results in a high thrust level throughout the entire burn period. This is in contrast to conventional tactical missile rocket motors which sometimes utilize a boost-sustain thrust profile, which starts at a high thrust level but over time falls to a lower thrust level. The boost-sustain thrust profile limits the performance advantages achieved with the present invention.

An all-boost grain design can result in vehicle velocities exceeding the current state-of-the-art design parameters due to the resulting increased thermal stress. The increases in thermal stress can be reduced by using, for example, a pulse motor design wherein the thrust is divided into two or more pulses and the propellant grains are separated by a pressure bulkhead. When necessary to reduce the maximum mach number to within design parameters, the rocket motor can have a delay between the pulses to allow the missile velocity to decrease before firing the next impulse. Grain patterns that are known to those of skill in the art can be utilized to obtain the all-boost thrust profile.

It is possible by selection of varied formulation parameters to control the ballistic behavior of the propellant. The slopes and burn rates can be tailored via formula modification. Additionally, changes in selection of the curative and particle size of the ballistic modifier can produce slopes at different burn rates and pressure regions.

A solid rocket propellant formulation, according to a preferred embodiment of the present invention, given the acronym IMAD-213 RDX and illustrated in Table 1C, is formulated from the following ingredients:

TABLE 1C

| Ingredient | Weight % (Approximate) |
|---|---|
| AP, 80–100 μm (Oxidizer) | 18–22 |
| AP, 10–15 μm (Oxidizer) | 18–22 |
| RDX (Oxidizer) | 8–10 |
| AN (Oxidizer) | 10–15 |
| Polymeric Binder | 6–6.5 |
| Al Fuel | 20–24 |
| Plasticizer | 4–16 |
| Cure Catalyst | 0.03–0.06 |
| Burn Rate Catalyst | 0.2–0.5 |
| Bonding Agent | 0.05–0.12 |
| Stabilizer | 0.3–0.4 |
| Curative | 0.9–1.9 |
| Crosslinker | 0.3–0.35 |

In the formulation for IMAD-213 RDX, ammonium perchlorate (AP) is generally incorporated into the formulation in the manner known in the art and AP may be used in multiple particle sizes. In a preferred embodiment of the present invention, the AP having a particle size from about 10–15 μm, preferably 11 μm, is used as a first oxidizer. The first oxidizer AP comprises about 18 weight % to about 22 weight %, preferably about 20 weight %. The AP having a particle size from about 80–100 μm, preferably 90 μm, is used as a secondary oxidizer. The second oxidizer AP comprises about 18 weight % to about 22 weight %, preferably about 20 weight %.

In the formulation for IMAD-213 RDX, a nitramine oxidizer, RDX, is incorporated to enhance energy, as illustrated in Table II, and obtain lower burning rates. In a preferred embodiment of the present invention, RDX can have a particle size in the range of about 1.7 μm to 2.5 μm, preferably about 1.7 μm. The RDX is incorporated at about 8–10 weight %, preferably at about 10 weight %.

The metal fuel used the IMAD-213 RDX formulations is Al fuel in a range of about 20–24 weight %, preferably about 20 weight %. The fuel can be comprised of aluminum metal with a particle size in the range of 30–95 μm, preferably about 95 μm.

AN is used in the propellant formulations as a co-oxidizer. In a preferred embodiment of the present invention, AN can have a particle size in the range of about 40–60 $\mu$m, preferably about 40 $\mu$m. The AN is incorporated at about 10–15 weight %, preferably at about 10 weight %.

The polymeric binder used in a preferred embodiment of the present invention is CAPA 720® (2-oxepanone, polymer with alpha-hydro-omega-hydroxypoly (oxy-1,4-butanediol)), which is a type of polycaprolactone. Suitable binders for IMAD-213 RDX also include other polycaprolactones, hydroxyl-terminated polyethers and polyesters known in the art. Other suitable binders include polyethylene glycol, copolymer of polyethylene glycol, polypropylene glycol and copolymer of polypropylene glycol. In a preferred embodiment of the present invention relating to IMAD-213 AP, the polymeric binder comprises about 6.0–6.5 weight % of the formulation, preferably at about 6.5 weight %.

Aluminum oxide is a suitable burn rate catalyst and is preferable to exotic burn rate catalysts such as superfine iron oxide, chromic oxide, catocene, or carboranes. Aluminum oxide is more environmentally friendly than the aforementioned exotic burn rate catalysts and aluminum oxide gives better IM effects. The aluminum oxide burn rate catalyst raises the burn rate at lower temperatures to create a consistent burn rate up to 8000 psi. In a preferred embodiment of the present invention, the aluminum oxide has a high surface area of 85–115 $m^2/g$. In a preferred embodiment of the present invention relating to IMAD-213 AP, the high surface area aluminum oxide comprises about 0.2–0.5 weight % of the formulation, preferably at about 0.3 weight %.

The basic formulation of IMAD-213 RDX consists of metal fuel, binder, oxidizers and a burn rate catalyst. However, cure catalysts, curatives, crosslinkers, thermal and aging stabilizers, opacifiers and other such ingredients commonly utilized in solid propellant formulations may be added, depending upon the desired characteristics.

A suitable stabilizer is MNA (N-methyl-p-nitroaniline). Other suitable stabilizers for nitrate esters include 2-NDPA (2-nitrodiphenylamine), and other stabilizers well known in the art. In a preferred embodiment of the present invention, MNA is incorporated at about 0.3–0.4 weight %, preferably at about 0.3 weight %.

A curative can also be added to the formulation, and examples of suitable curatives include polyfunctional isocyanates, such as HMDI (hexamethylene diisocyanate), TMXDI (m-tetramethylxylene diisocyanate), DDI (dimeryl diisocyanate), TDI (toluene diisocyanate), polymeric hexamethylene diisocyanate, IPDI (isophorone diisocyanate) and Desmodur N-100™ (biuret triisocyanate) as commercially available from Mobay. These curatives may be used independently or in combination. In a preferred embodiment of the present invention relating to IMAD-213 RDX, HMDI and N-100 are used in combination. HMDI is incorporated at about 0.5–0.7 weight %, preferably at about 0.57 weight % and N-100 is incorporated at about 0.4–1.2 weight %, preferably at about 0.89 weight %.

Suitable plasticizers include TEGDN, (triethyleneglycol dinitrate), or Butyl NENA, (n-butyl-2-nitratoethylnitramine) or mixtures of the two. Other suitable plasticizers include DEGDN (diethyleneglycol dinitrate), TMETN (trimethylolethane trinitrate), and BTTN (butanetriol trinitrate). These plasticizers may be used independently or in combination. In a preferred embodiment of the present invention relating to IMAD-213 RDX, TEGDN and Butyl NENA are used in combination. TEGDN is incorporated at about 2.0–8.0 weight %, preferably at about 5.7 weight % and Butyl NENA is incorporated at about 2.0–8.0 weight %, preferably at about 5.7 weight %.

TPB (triphenyl bismuth) is a suitable cure catalyst. Other suitable cure catalysts include TPTC (triphenyltin chloride), dibutyltin diacetate, and dibutyltin dilaurate. These compounds and others may be used as needed to prepare a propellant formulation with the specific desired characteristics. In a preferred embodiment of the present invention relating to IMAD-213 RDX, TPB comprises about 0.03–0.06 weight % of the formulation, preferably at about 0.03 weight %.

A crosslinker may be added to the formulation for IMAD-213 RDX. A suitable crosslinker is CAPA 316® which is a polyfunctional polymer in the same polymer family as CAPA 720®.

The mixing is accomplished using methods known in the art. The mixing of the aforementioned ingredients is accomplished by using a vertical shear mixer. At the end of mixing, the propellant mixture is vacuum cast into various molds or test items to determine various characteristics. For a more detailed description of mixing technique, refer to U.S. Pat. No. 5,712,511 issued to Chan et al. on Jan. 27, 1998, incorporated by reference herein.

The addition of a nitramine oxidizer, such as CL-20 or RDX, increases the performance of the formulations by increasing the chemical energy. Also, the addition of a nitramine oxidizer, such as CL-20 or RDX, decreases the burning rate, as shown in FIG. 5.

Depending on the desired application, the performance of the solid propellant according to the present invention may be further maximized by the use of an all-boost propellant grain design. An all-boost propellant grain design features a grain geometry that results in a high thrust level throughout the entire burn period. This is in contrast to conventional tactical missile rocket motors which sometimes utilize a boost-sustain thrust profile, which starts at a high thrust level but over time falls to a lower thrust level. The boost-sustain thrust profile limits the performance advantages achieved with the present invention.

An all-boost grain design can result in vehicle velocities exceeding the current state-of-the-art design parameters due to the resulting increased thermal stress. The increases in thermal stress can be reduced by using, for example, a pulse motor design wherein the thrust is divided into two or more pulses and the propellant grains are separated by a pressure bulkhead. When necessary to reduce the maximum mach number to within design parameters, the rocket motor can have a delay between the pulses to allow the missile velocity to decrease before firing the next impulse. Grain patterns that are known to those of skill in the art can be utilized to obtain the all-boost thrust profile.

It is possible by selection of varied formulation parameters to control the ballistic behavior of the propellant. The slopes and burn rates can be tailored via formula modification. Additionally, changes in selection of the curative and particle size of the ballistic modifier can produce slopes at different burn rates and pressure regions.

Experimental Results

The three families of propellant formulations provide a wide range of burning rate tailorability for system design. The following examples are presented to provide a more complete understanding of the invention. The specific techniques, conditions, materials, proportions and reported data set forth to illustrate the principles of the invention are exemplary and should not be construed as limiting the scope of the invention. Referring to Table 1D, preferred explosive compositions prepared according to the present invention are shown.

TABLE 1D

| Composition | Weight % of each ingredient | | |
|---|---|---|---|
| | IMAD-213 AP | IMAD-213 CL-20 | IMAD-213 RDX |
| AP, 90 μm | 18–24 | 18–24 | 18–22 |
| AP, 11 μm | 25–32 | — | 18–22 |
| AN, 40 μm | 10–15 | 25–32 | 10–15 |
| CL-20, 3 μm | — | 10–15 | — |
| RDX, 1.7 μm | — | — | 8–10 |
| CAPA 720 ® (HTCE) | 6–6.5 | 6–6.5 | 6–6.5 |
| CAPA 316 ® | — | — | 0.2–0.35 |
| Al Fuel, 95 μm | 19–24 | 19–24 | 20–24 |
| TEGDN w/.5% MNA | 0–3.0 | 0–3 | 2–8 |
| TMETN | — | — | 2–8 |
| Butyl NENA w/.5% MNA | 7–12 | 7–12 | — |
| TPB | 0.03–0.06 | 0.03–0.06 | 0.03–0.06 |
| Aluminum Oxide | 0.3–0.6 | 0.0–0.6 | 0.2–0.5 |
| HX-752 | — | 0.10–0.15 | 0.05–0.12 |
| HX-878 (Tepanol) | 0.05–0.12 | — | — |
| MNA | 0.3–0.4 | 0.3–0.4 | 0.3–0.4 |
| HMDI | 0.3–0.6 | 0.3–0.6 | 0.5–0.7 |
| N-100 ™ | 1.0–1.4 | 1.0–1.4 | 0.4–1.2 |

Figure 2:
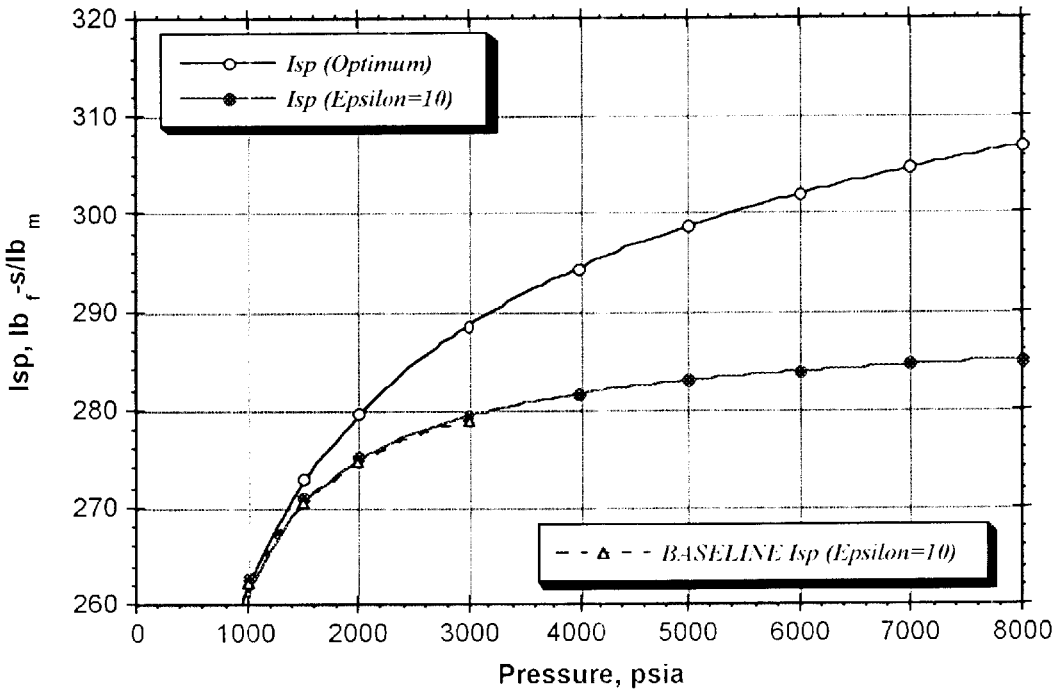
FIG. 2 is a graph, which illustrates the enhancement of calculated performance from higher chamber pressure of a preferred embodiment of the present invention in terms of chamber pressure versus burn rate for IMAD-213 AP.
Figure 3:
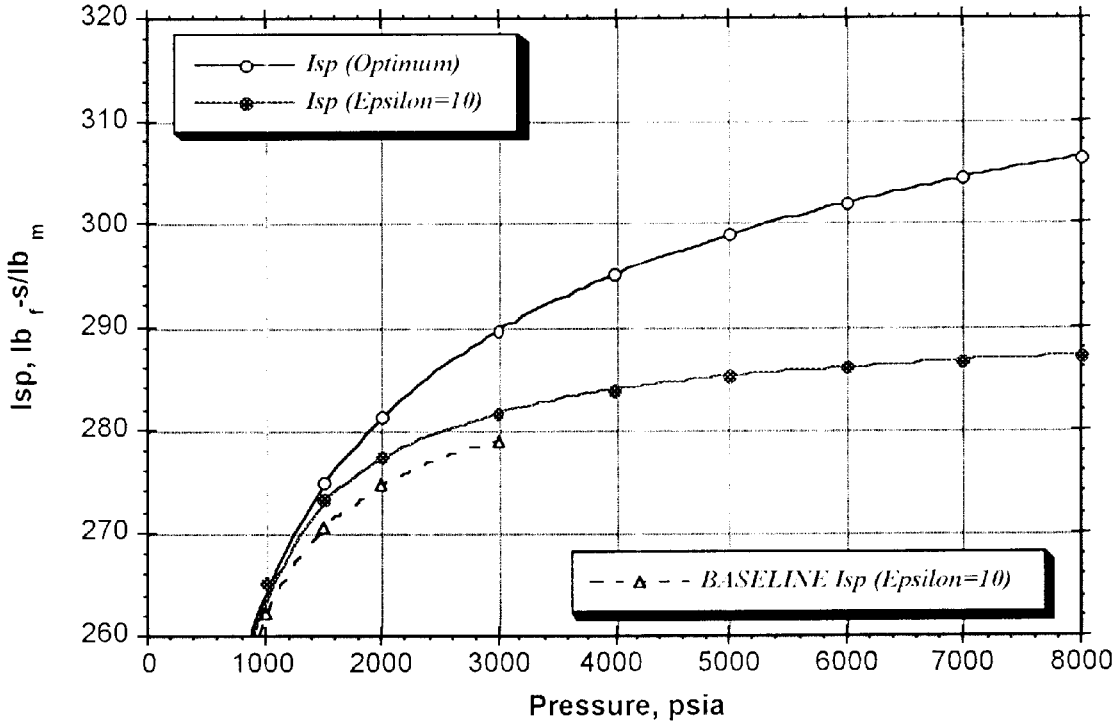
FIG. 3 is a graph, which illustrates the enhancement of calculated performance from higher chamber pressure of a preferred embodiment of the present invention in terms of chamber pressure versus burn rate for IMAD-213 CL-20.
Figure 4:
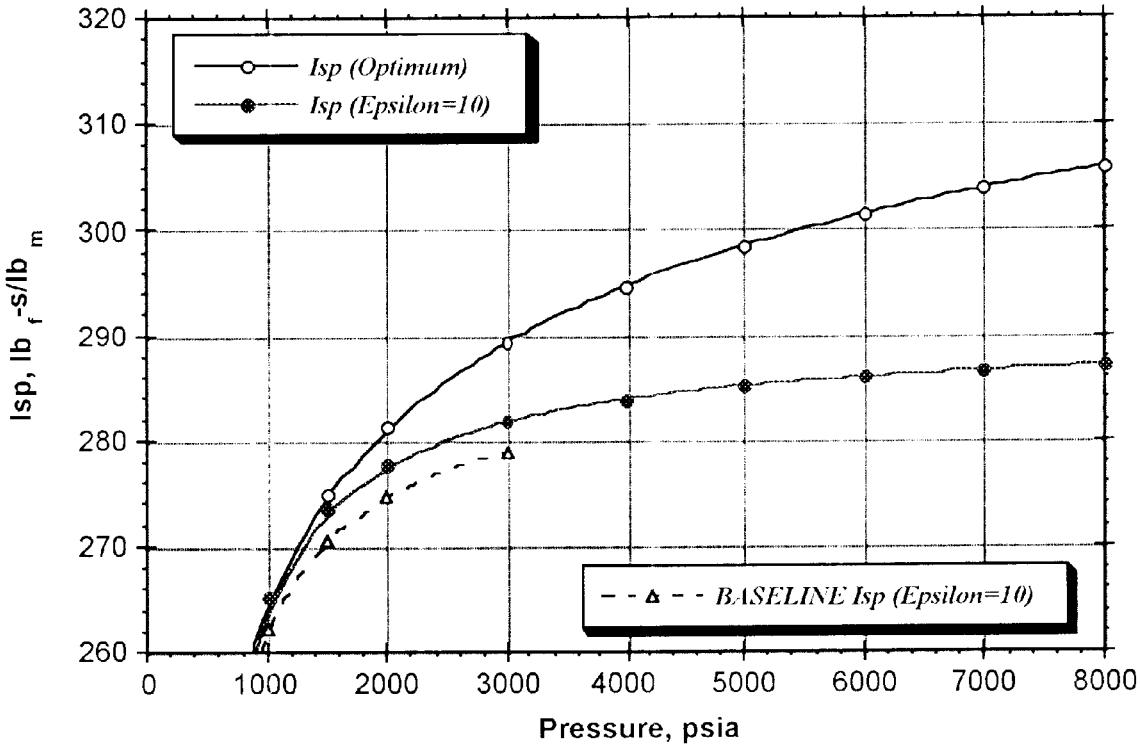
FIG. 4 is a graph, which illustrates the enhancement of calculated performance from higher chamber pressure of a preferred embodiment of the present invention in terms of chamber pressure versus burn rate for IMAD-213 RDX.

FIGS. 2, 3, and 4 illustrate that increased performance can be achieved if the chamber pressure is increased from a standard operating pressure of 1000 to 8000 psi. For example, if a motor loaded with one of these new propellants is fired at a 4000-psi chamber pressure, the calculated Isp performance can be as high as 295 seconds, which is substantially greater than that for state-of-the-art propulsion systems. The change in burn rate ($r_b$) as a function of the pressure change is defined as the burn rate slope, n:

$$n = \left(\frac{\partial \ln r_b}{\partial \ln P_c}\right)_T$$

Performance estimates for these new formulations were derived from thermochemical/thermodynamic calculations and are provided in Table II. The higher Isp values, particularly the Isp values IMAD-213 CL-20 and IMAD-213 RDX, indicate the increased performance. These results are compared with those of other conventional propellant materials.

TABLE II

| Performance Criteria | Baseline | | New Series | | |
|---|---|---|---|---|---|
| | HTPB/ AP/A1 | HTPE | IMAD-213 CL-20 | IMAD-213 RDX | IMAD-213 AP |
| Isp, s | 262.1 | 263.5 | 265.6 | 266.5 | 262.8 |
| Density x Isp | 17.34 | 17.25 | 17.35 | 17.04 | 17.03 |
| Density, lb/cm$^3$ | 0.06616 | 0.06548 | 0.06534 | 0.06394 | 0.06480 |
| Pressure slope break after 3000 psi | Present | Present | Absent | Absent | Absent |

The expansion conditions are important when comparing Isp values from different propellants. This point is necessary for comprehend the potential benefits of high-pressure operation while avoiding its pitfalls. The optimum Isp increases with pressure primarily because the expansion ratio (ϵ) increases to fulfill the constrain of ambient pressure at the nozzle exit. For most tactical and many strategic missiles, there is a geometric envelope requirement that limits the nozzle exit diameter and, therefore, ϵ. Referring to Table 3, the theoretical performance as a function of chamber pressure is presented for the IMAD-213-CL-20 propellant. At 1000 psia, the optimum ϵ is 10.4:1 and at 5000 psia, the optimum ϵ is 35.2:1. Depending upon the missile envelope, the propellant ballistics, and the throat diameter, the relatively large ϵ seen in Table III may not be physically allowed. For example, ϵ greater than 25:1 may not be possible due to launcher constraints. The practical value for Isp at high pressure falls somewhere between an upper and lower bound, and this value is dependent upon various engineering factors that include propellant grain design, burning rate, motor throat diameter, and missile configuration.

TABLE III

| Chamber Pressure, psia | Optimum Expansion Ratio (ϵ) |
|---|---|
| 500 | 6.08:1 |
| 1000 | 10.4:1 |
| 2000 | 17.5:1 |
| 3000 | 23.8:1 |
| 4000 | 29.7:1 |
| 5000 | 35.2:1 |
| 6000 | 40.5:1 |
| 7000 | 45.6:1 |
| 8000 | 50.6:1 |

The safety properties of these propellants, as illustrated in Table IV, indicate that they are well within the desired limits. In addition, no known processing or handling problems were detected during experimentation.

TABLE IV

| | Impact at 50% point, cm | ABL Friction @1000 lb | Electrostatic Discharge, 0.25 J |
|---|---|---|---|
| IMAD-213-CL-20 | 20 | 10/10 NF | 10/10 NF |
| IMAD-213-RDX | 20 | 10/10 NF | 10/10 NF |
| IMAD-213-AP | 17 | 10/10 NF | 10/10 NF |

All of the propellants of the present invention that were subjected Differential Scanning Calorimetric (DSC) and Vacuum Thermal Stability (VTS) screening tests exhibited no thermal stability or thermal compatibility problems. Their thermal properties are provided in Table V. Multiple peaks were observed in DSC analyses; they represent the decomposition of AN, CL-20, RDX, and AP.

TABLE V

| | VTS @80° C. | DSC (onset/peak), ° C. |
|---|---|---|
| IMAD-213-CL-20 | 0.5 $cm^3$/g/48 hr | 172/180, 219/225, 253/271 |
| IMAD-213-RDX | 0.02 $cm^3$/g/48 hr | 176/193, 227/237, 258/309 |
| IMAD-213-AP | 0.01 $cm^3$/g/48 hr | 171/184, 279/298, 348/365 |

Using both strand burning and high-pressure window bomb techniques, the burning rates of the preferred embodiments of the present invention were measured. Referring to FIG. 5, $r_b$ represents burning rate and $P_C$ represents chamber pressure. The burning rate slope is determined by using the aforementioned formula. The results for IMAD-213-RDX, IMAD-213-CL-20, and IMAD-213-AP were burn rate slopes of 0.371, 0.538, and 0.707 in/s at 1000 psi, as illustrated in FIG. 5. More importantly, however, is the fact that they exhibited a constant slope from 0.58 to 0.66 at up to 8000 psi and no slope break during the entire pressure range tested. This constant slope without break is a highly desirable combustion property intrinsic to the novel propellants of a preferred embodiment of the present invention.

The mechanical properties of the novel propellants of the current invention were optimized and the data are presented in the Table VI. This family of propellants exhibited excellent mechanical properties, as well as good strain capabilities in a wide temperature range. However, in order to achieve optimum performance, such as an enhancement of the propellant materials' stress and strain capabilities, the investigators found that the addition bonding agents helped achieve the aforementioned properties. For example, the use of HX-752 (0.12%) in the manufacturing process of IMAD-213-CL-20 and IMAD-213-RDX resulted in excellent strain capabilities (50 to 117%). However, HX-752 is not a good bonding agent for IMAD-213-AP. However, the addition of HX-878 (Tepanol, 0.06%) to IMAD-213-AP achieves moderately desirable properties. Unfortunately, the stress and strain capabilities attained were considerably less desirable than those obtained for IMAD-213-CL-20 and IMAD-213-RDX.

TABLE VI

| | Eo, psi | Sm, psi | Em, % | Eb, % |
|---|---|---|---|---|
| IMAD-213-CL-20 @ 145° F. | 234 | 60 | 90 | 93 |
| IMAD-213-CL-20 @ 77° F. | 309 | 108 | 112 | 117 |
| IMAD-213-CL-20 @ −45° F. | 3033 | 372 | 50 | 61 |
| IMAD-213-CL-20 @ −65° F. | 6538 | 588 | 46 | 54 |
| IMAD-213-RDX @ 145° F. | 188 | 56 | 52 | 53 |
| IMAD-213-RDX @ 77° F. | 209 | 88 | 68 | 71 |
| IMAD-213-RDX @ −45° F. | 2002 | 295 | 61 | 69 |
| IMAD-213-RDX @ −65° F. | 4427 | 405 | 66 | 70 |
| IMAD-213-AP @ 145° F. | 446 | 74 | 22 | 22 |
| IMAD-213-AP @ 77° F. | 621 | 122 | 23 | 24 |
| IMAD-213-AP @ −45° F. | 14560 | 871 | 11 | 18 |
| IMAD-213-AP @ −65° F. | 9144 | 755 | 15 | 32 |

The investigators subjected the IMAD-213-CL-20 and IMAD-213-RDX formulations to the NOL card gap test, 8 and the test results showed 50% points between 65 and 69 cards. While IMAD-213-AP was tested and the result is a zero card propellant, because there is no nitramine present.

The results for the Variable Confinement Cook-off Tests (VCCT), 9, 10 conducted for all three formulations, indicated a very mild reaction, as illustrated in Table VII. The results for IMAD-213-RDX and IMAD-213-AP formulations indicate a mild cookoff behavior. For the IMAD-213-CL-20 test, the investigators utilized a configuration with less confinement, and the result was also a very mild reaction

TABLE VII

| Formulation | Reaction | Material Temperature at Time of Cookoff, ° F. |
|---|---|---|
| IMAD-213-RDX | Burn | 345** |
| IMAD-213-AP | Burn, deflagration | 273, 288 |
| IMAD-213-CL-20* | Burn | 254 |

Test configuration: VCCT, highest confinement, 15 kpsi burst pressure, heating rate of 6° F./hr.
*IMAD-213-CL-20 was tested at 0.045-inch steel wall thickness (7725-psi burst pressure).
**Data lost, estimated temperature.

A new family of booster propellants was formulated to have highly desirable combustion characteristics and mild IM response. Higher delivered impulse, fast response, and greater maneuverability are compelling reasons for applying these propellants to higher-pressure operations.

Although the description above contains many specificities, these should not be construed as limiting the scope of the invention but as merely providing an illustration of the presently preferred embodiment of the invention. Thus the scope of this invention should be determined by the appended claims and their legal equivalents.

What is claimed is:

1. A solid propellant formulation having a pressure slope break occurring higher than about 2500 psi to 3500 psi comprising:

about 6.0 to about 6.5 weight % of at least one polymeric binder with at least one energetic plasticizer;

about 25 to about 32 weight % ammonium perchlorate having a particle size of about 10 $\mu$m to about 15 $\mu$m as a primary oxidizer;

about 18 to about 24 weight % ammonium perchlorate having a particle size of about 80 $\mu$m to about 100 $\mu$m as a secondary oxidizer;

about 10 to about 15 weight % of ammonium nitrate having a particle size of about 40 $\mu$m to about 60 $\mu$m as a co-oxidizer;

about 19 to about 24 weight % of a metal fuel; and about 0.3 to about 0.6 weight % of a burn rate catalyst;

wherein said solid propellant formulation has a burn rate of about 0.5 in/s at about 1000 psi and shows no pressure slope break up to about 8000 psi.

2. The solid propellant formulation of claim 1, wherein said secondary oxidizer has a particle size of about 90 $\mu$m.

3. The solid propellant formulation of claim 1, wherein said polymer binder consists essentially of a hydroxyl-terminated polycaprolactone polyether block polymer.

4. The solid propellant formulation of claim 1, wherein said polymer binder is selected from the group consisting of 2-oxepanone, polymer with 2,2-bis(hydroxymethyl)-1,3-propanediol and 2-oxepanone, polymer with alpha-hydro-omega-hydroxypoly(oxy-1,4-butanediol).

5. The solid propellant formulation of claim 1, wherein said metal fuel is aluminum fuel.

6. The solid propellant formulation of claim 5, wherein said aluminum fuel has a particle size of about 30 $\mu$m to about 95 $\mu$m.

7. The solid propellant formulation of claim 1, further comprising at least one member selected from a plasticizer, a curative, a stabilizer, a cure catalyst, and a bonding agent.

8. The solid propellant formulation of claim 7, wherein said plasicizer is selected from the group consisting of triethyleneglycol dinitrate, or n-butyl-2-nitratoethyl-nitramine diethyleneglycol dinitrate, trimethylolethane trinitrate, butanetriol trinitrate and any combination thereof.

9. The solid propellant formulation of claim 7, wherein said plasticizer is a combination of n-butyl-2-nitratoethyl-nitramine and triethyleneglycol dinitrate.

10. The solid propellant formulation of claim 7, wherein said curative is selected from the group consisting of hexamethylene diisocyanate, m-tetramethylxylene diisocyanate, dimeryl diisocyanate, toluene diisocyanate, polymeric hexamethylene diisocyanate, isophorone diisocyanate, biuret triisocyanate and any combination thereof.

11. The solid propellant formulation of claim 7, wherein said cure catalyst is selected from the group consisting of triphenyl bismuth triphenyltin chloride, dibutyltin diacetate and dibutyltin dilaurate.

12. The solid propellant formulation of claim 7, wherein said stabilizer is selected from the group consisting of N-methyl-p-nitroaniline and 2-NDPA (2-nitrodiphenylamine).

13. The solid propellant formulation of claim 1, wherein said burn rate catalyst is aluminum oxide having a surface of about 85 to about 115 $m^2/g$.

* * * * *